US007607394B2

(12) United States Patent
Cesaroni

(10) Patent No.: US 7,607,394 B2
(45) Date of Patent: Oct. 27, 2009

(54) LEAD-FREE PROJECTILES

(76) Inventor: Anthony Joseph Cesaroni, 45 Cedar Ridge Road, Unionville, Ontario (CA) L0H 1G0

( * ) Notice: Subject to any disclaimer, the term of this patent is extended or adjusted under 35 U.S.C. 154(b) by 588 days.

(21) Appl. No.: 10/474,512

(22) PCT Filed: Apr. 24, 2002

(86) PCT No.: PCT/CA02/00583

§ 371 (c)(1),
(2), (4) Date: Mar. 4, 2004

(87) PCT Pub. No.: WO02/086412

PCT Pub. Date: Oct. 31, 2002

(65) Prior Publication Data

US 2004/0129165 A1 Jul. 8, 2004

Related U.S. Application Data

(60) Provisional application No. 60/286,172, filed on Apr. 24, 2001.

(51) Int. Cl.
*F42B 12/78* (2006.01)

(52) U.S. Cl. ..... 102/516; 102/517

(58) Field of Classification Search ..... 102/516, 102/515, 517, 518, 519, 514
See application file for complete search history.

(56) References Cited

U.S. PATENT DOCUMENTS 867,509 A * 10/1907 Holland et al. ..... 200/470
998,307 A * 7/1911 Schouboe ..... 102/516
3,357,357 A * 12/1967 Voss ..... 102/516
3,720,170 A * 3/1973 Godfrey ..... 102/516
4,336,756 A * 6/1982 Schreiber ..... 102/516
4,338,862 A * 7/1982 Kwatnoski et al. ..... 102/516
4,503,777 A 3/1985 Young
4,517,898 A 5/1985 Davis et al.
4,607,573 A 8/1986 Thureson et al.
4,753,172 A * 6/1988 Katzmann et al. ..... 102/517
5,012,743 A 5/1991 Denis
5,237,930 A * 8/1993 Belanger et al. ..... 102/529
5,394,597 A * 3/1995 White ..... 86/55
5,399,187 A 3/1995 Mravic et al.
5,454,325 A * 10/1995 LeBlanc ..... 102/506
5,496,918 A 3/1996 Khanna et al.

(Continued)

FOREIGN PATENT DOCUMENTS

CH 482 167 11/1969

(Continued)

OTHER PUBLICATIONS

Google, Web definition of the term "cold pressed", 1 page, 2006.*

(Continued)

*Primary Examiner*—Stephen M Johnson

(57) ABSTRACT

A lead-free projectile having a metal jacket (10) with a tip in the form of a truncated parabellum. The metal jacket (10) is partially filled with cold-pressed metal powder (18), the remainder of the metal jacket being filled with metal-filled polymer (26). The metal-filled polymer (26) extends through the truncated parabellum and forms a tip on the projectile. A projectile (bullet) having a higher grain is obtained. Methods of manufacture are also disclosed.

30 Claims, 2 Drawing Sheets

U.S. PATENT DOCUMENTS

| | | | | | |
|---|---|---|---|---|---|
| 5,597,973 | A | | 1/1997 | Gladden et al. | |
| 5,616,642 | A | | 4/1997 | West et al. | |
| 5,722,035 | A | * | 2/1998 | Matysik et al. | 419/28 |
| 5,730,664 | A | | 3/1998 | Asakura et al. | |
| 5,747,722 | A | | 5/1998 | Gladden et al. | |
| 5,786,416 | A | | 7/1998 | Gardner et al. | |
| 5,837,924 | A | | 11/1998 | Austin | |
| 5,847,313 | A | * | 12/1998 | Beal | 102/516 |
| 5,963,776 | A | * | 10/1999 | Lowden et al. | 419/64 |
| 6,016,754 | A | * | 1/2000 | Enlow et al. | 102/516 |
| 6,085,661 | A | * | 7/2000 | Halverson et al. | 102/516 |
| 6,090,178 | A | | 7/2000 | Benini | |
| 6,174,494 | B1 | * | 1/2001 | Lowden et al. | 419/66 |
| 6,178,890 | B1 | * | 1/2001 | Burczynski | 102/507 |
| 6,257,149 | B1 | | 7/2001 | Cesaroni | |
| 6,371,029 | B1 | * | 4/2002 | Beal | 102/516 |
| 6,381,825 | B1 | * | 5/2002 | Regis et al. | 29/419.1 |
| 6,629,485 | B2 | * | 10/2003 | Vaughn et al. | 86/55 |
| 6,691,623 | B1 | * | 2/2004 | Stone | 102/506 |
| 2001/0050020 | A1 | * | 12/2001 | Davis et al. | 102/506 |
| 2003/0221580 | A1 | * | 12/2003 | Beal | 102/516 |

FOREIGN PATENT DOCUMENTS

| | | |
|---|---|---|
| DE | 92 09 598.4 | 12/1992 |
| FR | 2691156 | 11/1993 |
| GB | 1175274 | 12/1969 |
| WO | WO 92/08097 | 5/1992 |
| WO | WO 93/16349 | 8/1993 |
| WO | WO 94/11697 | 5/1994 |
| WO | WO 95/08748 | 3/1995 |
| WO | WO 95/23952 | 9/1995 |
| WO | WO 97/38282 | 10/1997 |

OTHER PUBLICATIONS

Hawley; The Condensed Chemical Dictionary; 1974; 2 pages.*
Webster's Encyclopedic Unabridged Dictionary; 3 pages including p. 983; 1966.*
International Publication WO 97 20185 published Jun. 5, 1997.
International Publication WO 99 18409 published Apr. 15, 1999.
International Publication WO 98 46963 published Oct. 22, 1998.

* cited by examiner

LEAD-FREE PROJECTILES

CROSS-REFERENCE TO RELATED APPLICATIONS

This application is a National Stage entry of International Application No. PCT/CA02/00583, filed on Apr. 24, 2002, the entire specification, claims, and drawings of which are incorporated herewith by reference; which claims benefit from provisional U.S. Application No. 60/286,172, filed on Apr. 24, 2002.

FIELD OF THE INVENTION

The present invention relates to lead-free projectiles, especially bullets, and in particular to lead-free projectiles of increased density (grain). The present invention also relates to methods of manufacture of such projectiles.

BACKGROUND TO THE INVENTION

Firearms are used in a variety of ways, including hunting and sporting activities, law enforcement activities and military activities. In hunting activities, spent bullets or parts of spent bullets remain in the environment. They may be eaten by game, or other animals or birds, either inadvertently or out of curiosity. This can cause poisoning effects, depending on the type of bullet. If the bullets contain lead, poisoning and environmental effects pose significant concerns about health issues, and have resulted in governmental regulations concerning the banning of the use of lead in bullets. In sporting activities and testing of bullets at a firing range, fumes from lead bullets pose a significant health issue.

Lead-free bullets are known. For instance, U.S. Pat. No. 5,399,187 discloses a bullet formed from tungsten, or an alloy of tungsten, and phenol formaldehyde or polymethylmethacrylate polymers, U.S. Pat. No. 5,012,743 discloses a light weight elongated projectile formed from a casing of copper alloy, steel or similar material and a lower density core e.g. polycarbonate or polyamide. WO 95/23952 discloses a projectile having a core of polyethylene and iron. Projectiles formed from bismuth alloys are disclosed in WO 92/08097 and WO 95/08748.

Lead-free bullets that are particularly intended to retain markings of the barrel of the firearm after the bullet is fired are disclosed in U.S. patent application Ser. No. 09/101,844, filed Oct. 5, 1998 of A. J. Cesaroni. Such bullets have a core formed from a lead-free composition of a filler and an amorphous or low crystallinity polymer e.g. ethylene/methacrylic acid copolymer ionomers, polyetherester elastomers and polyamides. Examples of the filler include copper, tungsten, bismuth, tin and stainless steel. In embodiments, the shell or casing of the bullet may be a truncated cone or truncated parabellum, and the tip may be parabolic, rounded or hollow point.

Lead-free projectiles that are currently being manufactured have, for 0.223 calibre, a maximum weight of about 50 grains. Higher weights for the same calibre would have greater impact during use.

Examples of lead-free projectiles are being manufactured from powdered metals using a sintering process. However, such projectiles do not give the desired results when penetrating tissue. The projectile tends to remain intact and consequently induces minimal trauma when penetrating tissue. Moreover, the projectile will ricochet if it hits a hard object, scattering projectile materials and potentially injuring innocent persons, including the shooter. In addition, the manufacturing process typically includes a step of crimping the projectile into a brass casing, and that step may lead to fracture of the projectile.

A lead-free projectile that could be manufactured with a higher weight, and a manufacturing process that is not susceptible to the above defects of manufacture would be useful.

SUMMARY OF THE INVENTION

One aspect of the present invention provides a lead-free projectile having a metal jacket with a tip in the form of a truncated parabellum, said metal jacket being partially filled with cold-pressed metal powder, the remainder of the metal jacket being filled with metal-filled polymer, said metal-filled polymer extending through the truncated parabellum and forming a tip on said projectile.

In preferred embodiments of the invention, the projectile is a bullet.

In further embodiments, the jacket is a copper jacket.

In still further embodiments, the metal powder is copper or tungsten.

In another embodiment, the metal-filled polymer is an amorphous or low crystallinity polymer, especially ethylene/methacrylic acid copolymer ionomer, polyetherester elastomer or polyamide, filled with particles of copper, tungsten, bismuth, tin and/or stainless steel.

Another aspect of the present invention provides a method of forming a lead-free projectile, comprising:

(a) placing a pre-formed open ended metal jacket in a mould, said jacket being formable under pressure;

(b) adding a pre-determined amount of metal powder into said jacket;

(c) compacting said powder by cold pressing the powder in the jacket;

(d) forming the open end of the jacket into a truncated parabellum; and (e) filling the jacket by injecting a metal-loaded polymer therein and forming a tip of said metal-loaded polymer on the projectile exterior to the truncated parabellum.

In preferred embodiments of the method of the invention, the projectile is a bullet.

In further embodiments, the jacket is a copper jacket.

In still further embodiments, the metal powder is copper or tungsten.

In another embodiment, the metal-filled polymer is an amorphous or low crystallinity polymer, especially ethylene/methacrylic acid copolymer ionomer, polyetherester elastomers or polyamide, filled with particles of copper, tungsten, bismuth, tin and/or stainless steel.

A further aspect of the invention provides a method of forming a lead-free projectile, comprising:

(a) placing a pre-formed open ended metal jacket in a mould, said jacket being formable under pressure;

(b) partially filling the jacket by injecting a metal-loaded polymer therein;

(c) adding metal powder into said jacket;

(d) compacting said powder by cold pressing the powder in the jacket; and (e) closing the open end of the jacket.

In embodiments of the method, the jacket has a pre-formed truncated parabellum, and a tip of said metal-loaded polymer is formed on the projectile in step (b).

In preferred embodiments of the method of the invention, the projectile is a bullet.

In further embodiments, the jacket is a copper jacket.

In still further embodiments, the metal powder is copper or tungsten.

In another embodiment, the metal-filled polymer is an amorphous or low crystallinity polymer, especially ethylene/methacrylic acid copolymer ionomer, polyetherester elastomers or polyamide, filled with particles of copper, tungsten, bismuth, tin and/or stainless steel.

In another aspect of the invention, there is provided a lead free projectile comprising a preformed metal jacket having an open end and a closed tip end, said metal jacket being filled with cold-pressed powder and said open end being sealed with a metal filled polymer.

In a preferred embodiment, the open end of said jacket curves inward to retain the polymer over the powder.

In a further aspect of the invention, there is provided a method of forming a lead-free projectile, comprising:

a) providing a pre-formed metal jacket, having an open end and a closed tip end;

b) adding a predetermined amount of metal powder into the jacket through the open end;

c) compacting said powder by cold-pressing the powder in the jacket; and d) filling the jacket with a metal-loaded polymer thereby closing the open end.

BRIEF DESCRIPTION OF THE DRAWINGS

The present invention is illustrated by the embodiment shown in the drawings, in which:

FIG. 6 is a schematic representation of an empty jacket for the projectile according to another aspect of the invention;

FIG. 7 is a schematic representation of the projectile of FIG. 6 partially filled with metal powder;

FIG. 8 is a schematic representation of the projectile of FIG. 7 with the metal powder having been compacted;

FIG. 9 is a schematic representation of the projectile with the open end folded in; and FIG. 10 is a schematic representation of the projectile sealed with metal-filled polymer.

DETAILED DESCRIPTION OF THE INVENTION

The present invention relates to a lead-free projectile, and especially to a lead-free projectile that has an increased weight (grain) compared to other lead-free projectiles of the same size. The invention also relates to the method of forming the projectile.

Figure 1:
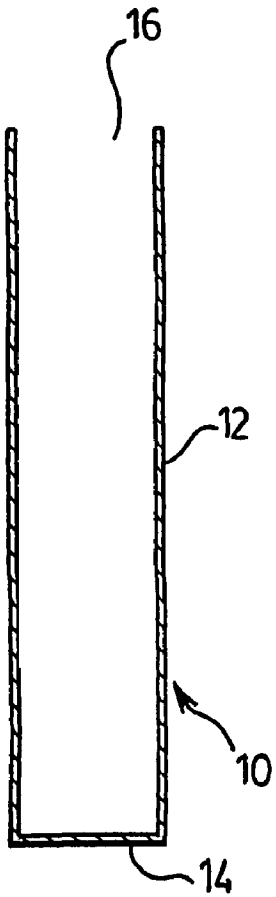
FIG. 1 is a schematic representation of an empty jacket for the projectile according to one aspect of the invention.

FIG. 1 shows a metal jacket, generally indicated by 10. Metal jacket 10 is in the form of a cylindrical body 12 that has a closed end 14 and an open end 16. The jacket may be made from a number of metals, provided that the metal is capable of being formed as described below. The preferred metal is copper.

Figure 2:
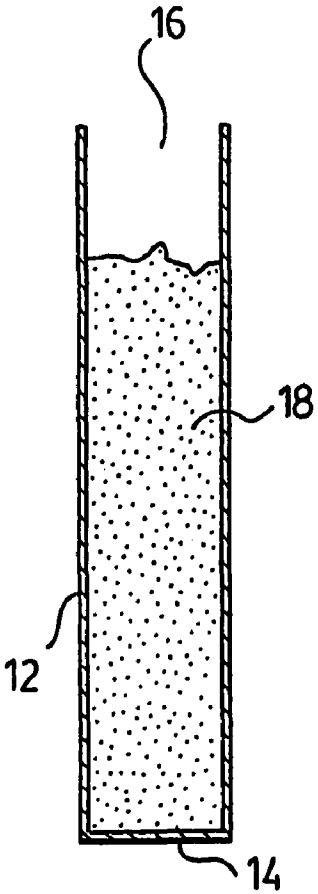
FIG. 2 is a schematic representation of the projectile of FIG. 1 partially filled with metal powder.

FIG. 2 shows metal jacket 10 partially filled with metal powder 18. The amount of metal powder may be varied, but the increase in grain of the resultant projectile will be related to the amount of metal powder that is added to the metal jacket. The amount of metal powder for a particular projectile would be pre-determined, and precisely metered into the jacket, to ensure consistency in manufacture of the projectiles. In embodiments of the invention, the amount of metal powder is 20-90% and especially 40-80% of the volume of the jacket, after the metal powder has been compacted as described below. The upper limit of the amount of metal powder is determined by the volume of the jacket prior to compacting of the metal powder, as the jacket can only be completely filled with metal powder prior to the compacting step. The metal powder must be capable of being cold pressed, as described below. Examples of the metal powder include copper and tungsten, including mixtures thereof.

Figure 3:
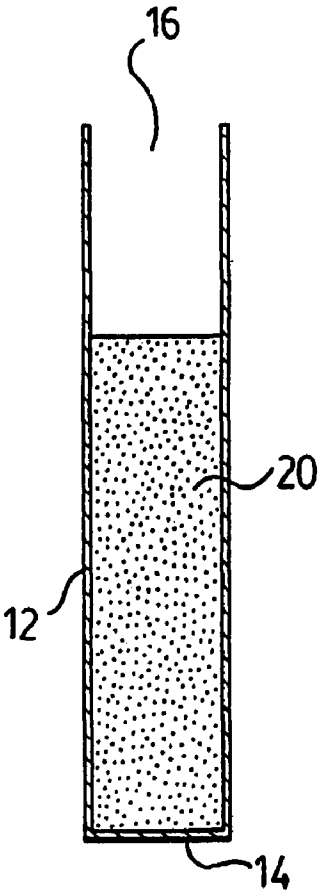
FIG. 3 is a schematic representation of the projectile of FIG. 2 with the metal powder having been compacted.

FIG. 3 shows jacket 10 with metal powder 18 having being compacted, thereby forming compacted metal powder 20. The metal powder is compacted by cold pressing i.e. the powder is subjected to pressure by a piston that passes through open end 16 and compacts the metal powder. Such pressing is done at or about ambient temperature.

Figure 4:
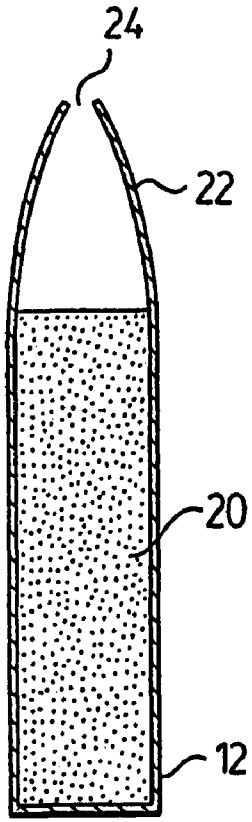
FIG. 4 is a schematic representation of the projectile of FIG. 3 with the jacket formed into a truncated parabellum.

FIG. 4 shows jacket 10 having being formed so that open end 16 is a truncated parabellum 22 with open tip 24. Jacket 10 may be so formed using a metal forming process e.g. closing a mould over open end 16 of jacket 10. In particular, the closing of the mould used in the subsequent step of injecting metal-filled polymer may also effect the shaping of jacket 10.

Figure 5:
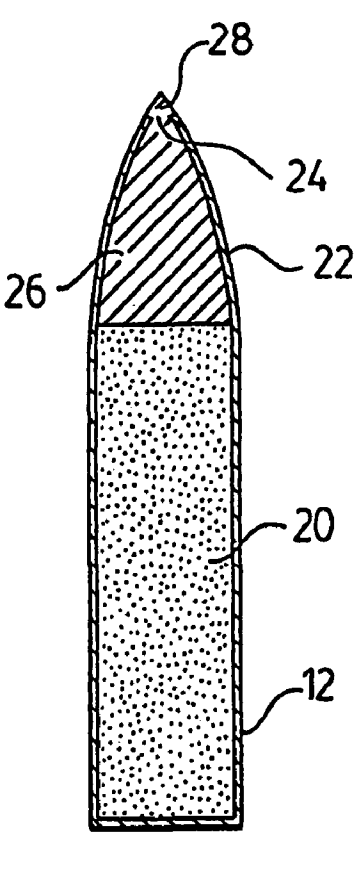
FIG. 5 is a schematic representation of the projectile of FIG. 4 filled with metal-filled polymer.

FIG. 5 shows jacket 10 filled with metal-filled polymer 26. Metal-filled polymer 26 completely fills jacket 10 and extends through open tip 24 of parabellum 22 to form projectile tip 28. A variety of metal filled polymers may be used. In preferred embodiments, the metal-filled polymer is an amorphous or low crystallinity polymer, especially ethylene/methacrylic acid copolymer ionomer, polyetherester elastomers or polyamide. The preferred polymer is ionomer. It is understood that the polymer would have a molecular weight suitable for injection moulding and the intended use. The metal-filled polymer may be filled with a variety of types of metal particles, for example particles of copper, tungsten, bismuth, tin and/or stainless steel. It is understood that lead would not be used, as the projectile is a lead-free projectile. The amount of filler may be varied over a wide-range, including up to at least 80% by weight of filler.

Examples of ethylene/methacrylic acid copolymer ionomers are ethylene/methacrylic acid copolymers that have been partially neutralized with metals ions such as sodium or zinc. Such polymers are available from E.I. du Pont de Nemours and Company under the trademark Surlyn. It is preferred that the ionomer not be too viscous, for ease of dispersion of filler particles in the composition e.g. have a melt index of at least 5; melt index is measured by the procedure of ASTM 1238. Examples of polyamides include nylon 11, nylon 12, nylon 12/12 and related amorphous or low crystallinity polyamides. The polymer may also be a polyetherester elastomer e.g. an elastomer available from E.I. du Pont de Nemours and Company under the trademark Hytrel. Blends of such polymers or of such polymers with other polymers to provide amorphous or low crystallinity polymers may also be used.

The method discussed with reference to FIGS. 1-5 may be conveniently carried out in a mould of an injection moulding apparatus. For instance, the jacket may be placed in the mould, and the required amount of metal powder metered into the jacket. A rod may be inserted into the jacket to compact the metal powder. The mould of the injection moulding apparatus may then be closed, at which time the open end of the jacket is formed into the truncated parabellum. Metal filled polymer is then injected into the formed jacket, the mould being of a shape to form the tip on the projectile. In embodiments, the tip is parabolic, rounded or hollow point.

The method above has been described herein with reference to the method shown in FIGS. 1-5. It is understood however that the projectile could be formed in the opposite manner. For instance, a jacket open at both ends could be used, one end being the truncated parabellum, which would be at the bottom of the mould. Metal-filled polymer would then be injected, at which time the tip would be formed. Metal powder would then be metered in and compacted. Finally, the open end of the jacket would be closed. Alternatively, in this embodiment of the method of the invention, the tip of the bullet could be metal tip i.e. instead of using an open-ended jacket and forming a truncated parabellum and thereafter forming a tip with metal-filled polymer, the jacket could have a pre-formed metal tip of the required shape. Metal-filled polymer would then be injected followed by metal powder and closing of the end of the bullet, as described immediately above.

The projectile described above has a metal-filled polymer as the tip. Such a tip would be expected to fracture on impact with an object. In addition, the projectile has a substantial component that is composed of loosely bonded metal particles. Thus, on hitting a hard object, the projectile would be expected to disintegrate, and therefore would not be expected to ricochet. All parts of the projectile would be expected to disintegrate and/or turn to powder, including the jacket.

FIGS. 6 to 10 illustrate another type of projectile according to the present invention and the method used to form such a projectile. In this aspect of the invention, a preformed metal jacket is filled with metal powder, the powder is cold-pressed and then the open end of the jacket is sealed with a metal polymer.

Figures 6, 7, 8, 9, 10:
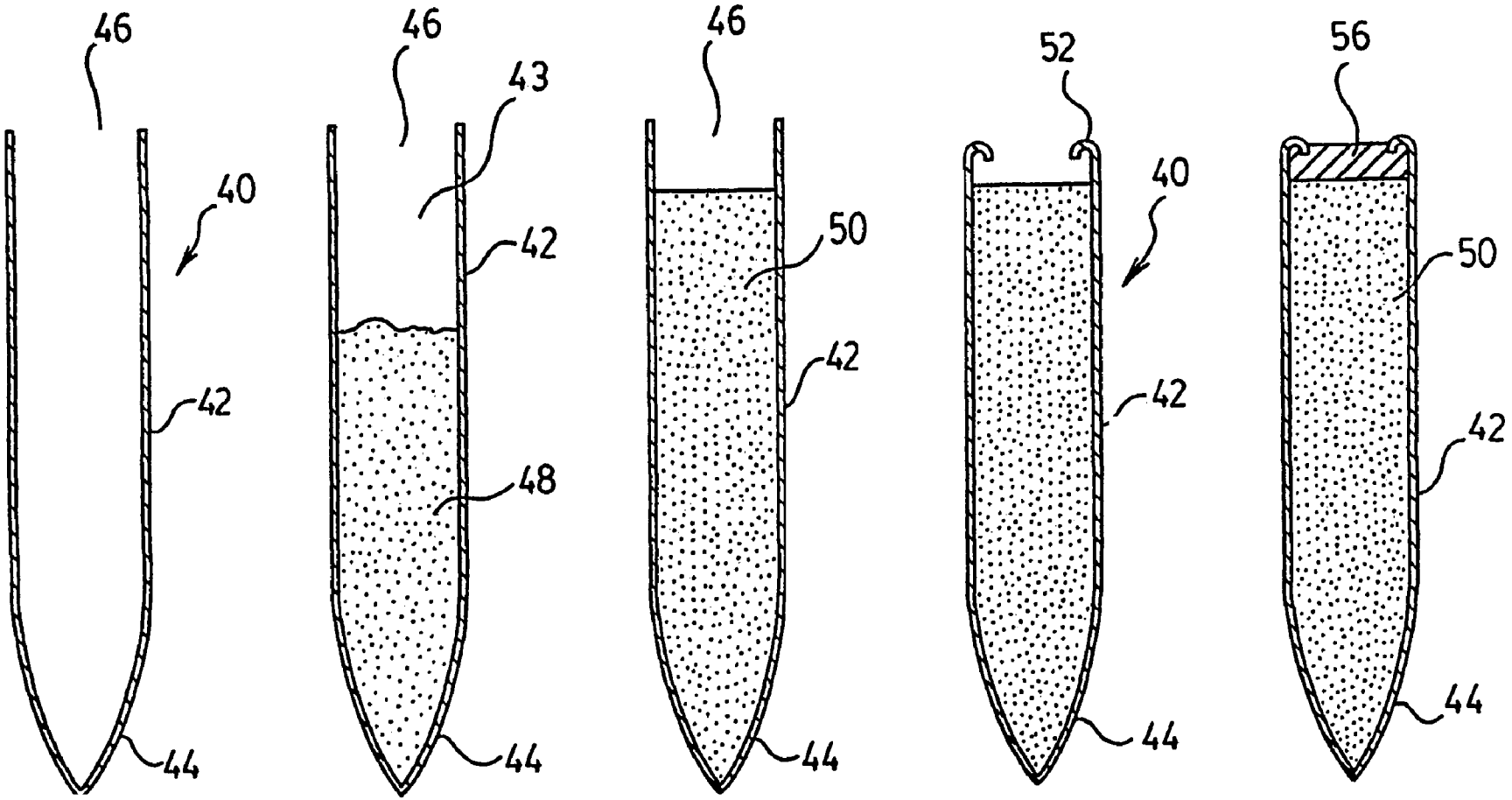

FIG. 6 shows a metal jacket, generally indicated by 40. Metal jacket 40 is in the form of a cylindrical body 42 that has a closed tip end 44 and an open end 46. The jacket may be made from a number of metals, provided that the metal is capable of being formed as described below. The preferred metal is copper.

FIG. 7 shows the cavity 43 of the metal jacket 40 partially filled with metal powder 48. The amount of metal powder may be varied, but the increase in grain of the resultant projectile will be related to the amount of metal powder that is added to the metal jacket. The amount of metal powder for a particular projectile is pre-determined, and precisely metered into the jacket, to ensure consistency in manufacture of the projectiles. Examples of the metal powder include copper and tungsten, including mixtures thereof.

FIG. 8 shows jacket 40 with metal powder 48 having being compacted, thereby forming compacted metal powder 50. The metal powder is compacted by cold pressing i.e. the powder is subjected to pressure by a piston that passes through open end 26 and compacts the metal powder. Such pressing is done at or about ambient temperature.

FIG. 9 shows jacket 40 having being formed so that the open end 46 has the edge 52 folded inwards.

FIG. 10 shows jacket 40 filled with metal-filled polymer 56. Metal-filled polymer 56 completely covers the compacted powder 50 and seals the cavity of the jacket. The curved edge 52 retains the filling in the jacket. A variety of metal filled polymers may be used. In preferred embodiments, the metal-filled polymer is an amorphous or low crystallinity polymer, especially ethylene/methacrylic acid copolymer ionomer, polyetherester elastomers or polyamide. The preferred polymer is ionomer. It is understood that the polymer would have a molecular weight suitable for injection moulding and the intended use. The metal-filled polymer may be filled with a variety of types of metal particles, for example particles of copper, tungsten, bismuth, tin and/or stainless steel. It is understood that lead would not be used, as the projectile is a lead-free projectile. The amount of filler may be varied over a wide range, including up to at least 80% by weight of filler.

Examples of ethylene/methacrylic acid copolymer ionomers are ethylene/methacrylic acid copolymers that have been partially neutralized with metals ions such as sodium or zinc. Such polymers are available from E.I. du Pont de Nemours and Company under the trademark Surlyn. It is preferred that the ionomer not be too viscous, for ease of dispersion of filler particles in the composition e.g. have a melt index of at least 5; melt index is measured by the procedure of ASTM 1238. Examples of polyamides include nylon 11, nylon 12, nylon 12/12 and related amorphous or low crystallinity polyamides. The polymer may also be a polyetherester elastomer e.g. an elastomer available from E.I. du Pont de Nemours and Company under the trademark Hytrel. Blends of such polymers or of such polymers with other polymers to provide amorphous or low crystallinity polymers may also be used.

The present invention is illustrated by the following example.

EXAMPLE 1

Projectiles in the form of 0.223 calibre (5.56 mm) bullets were made in two different weights, 58 grains and 63 grains.

The 58 grain bullet had a copper jacket weighing 19 grains, copper powder weighing 33 grains and copper-filled ionomer weighing 6 grains. The copper-filled ionomer had greater than 90% by weight of copper and less than 10% by weight of ionomer.

The 63 grain bullet had a copper jacket weighing 19 grains, a mixture of copper and tungsten powder weighing 38 grains and copper-filled ionomer weighing 6 grains. The copper-filled ionomer had greater than 90% by weight of copper and less than 10% by weight of ionomer.

The bullets were formed using the process described above. The metal powder was metered into the jacket, which had an open top and a square bottom. The metal powder was cold pressed into the jacket. The filled jacket was then placed into a mould of an injection moulding apparatus. The apparatus was designed so that when the mould was closed, the top of the jacket was formed into a truncated parabellum. The metal-filled polymer was then injected into the jacket, using an injection moulding process, at which time the tip of the bullet was formed.

Both types of bullets were assembled in the form of live ammunition and fired at a target using a number of weapons. Both types of bullets were very accurate, and performed as well as or better than commercial lead bullets of the same calibre. The bullets turned to powder when fired at a steel plate, thereby demonstrating anti-ricochet properties of the bullets.

The invention claimed is:

1. A lead-free projectile having a metal jacket with a tip in the form of a truncated parabellum, said metal jacket being partially filled with cold-pressed metal powder and being filled with metal-filled polymer, said metal-filled polymer extending through the truncated parabellum and forming a tip on said projectile.

2. The lead-free projectile of claim 1 in which the projectile is a bullet.

3. The lead-free projectile of claim 1 in which the jacket is a copper jacket.

4. The lead-free projectile of claim 1 in which the metal powder is copper or tungsten.

5. The lead-free projectile of claim 1 in which the metal-filled polymer comprises a polymer filled with particles of at least one of copper, tungsten, bismuth, tin and stainless steel.

6. The lead-free projectile of claim 5 in which the polymer is selected from the group consisting of ethylene/methacrylic acid copolymer ionomer, polyetherester elastomers and polyamide.

7. The lead-free projectile of claim 6 in which the polymer comprises an ethylene/methacrylic acid copolymer ionomer.

8. The lead-free projectile of claim 7 in which the ethylene/methacrylic acid copolymer ionomer has a melt index of at least 5.

9. The lead-free projectile of claim 6 in which the polymer is a polyamide.

10. The lead-free projectile of claim 9 in which the polyamide is nylon.

11. The lead-free projectile of claim 1 in which an amount of metal powder is 20 to 90% of the volume of the jacket.

12. The lead-free projectile of claim 1 in which an amount of metal powder is 40 to 80% of the volume of the jacket.

13. The lead-free projectile of claim 1 in which the tip of the parabellum is one of parabolic, rounded and hollow point.

14. The lead-free projectile of claim 1, wherein the metal-filled polymer comprises an ionomer.

15. The lead-free projectile of claim 1, wherein the metal-filled polymer comprises an amorphous polymer.

16. A method of forming a lead-free projectile, comprising:

(a) placing a pre-formed open ended metal jacket in a mould, said jacket being formable under pressure;

(b) adding a pre-determined amount of metal powder into said jacket;

(c) compacting said powder by cold pressing the powder in the jacket;

(d) forming the open end of the jacket into a truncated parabellum; and (e) filling the jacket by injecting a metal-loaded polymer therein and forming a tip of said metal-loaded polymer on the projectile exterior to the truncated parabellum.

17. The method of claim 16 in which the projectile is a bullet.

18. The method of claim 16 in which the jacket is a copper jacket.

19. The method of claim 16 in which the metal powder is copper or tungsten.

20. The method of claim 16 in which the metal-filled polymer comprises a polymer filled with particles of at least one of copper, tungsten, bismuth, tin and stainless steel.

21. The method of claim 16 in which the polymer is selected from the group consisting of ethylene/methacrylic acid copolymer ionomer, polyetherester elastomer and polyamides.

22. The method of claim 21 in which the polymer is the ethylene/methacrylic acid copolymer ionomer.

23. The method, of claim 22 in which the ethylene/methacrylic acid copolymer ionomer has a melt index of at least 5.

24. The method of claim 21 in which the polymer is a polyamide.

25. The method of claim 24 in which the polyamide is nylon.

26. The method of claim 16 in which the amount of metal powder is 20 to 90% of the volume of the jacket.

27. The method of claim 16 in which the amount of metal powder is 40 to 80% of the volume of the jacket.

28. The method of claim 16 in which the tip is one of parabolic, rounded and hollow point.

29. The lead-free projectile of claim 16, wherein the metal-filled polymer comprises an ionomer.

30. The lead-free projectile of claim 16, wherein the metal-filled polymer comprises an amorphous polymer.

* * * * *